United States Patent [19]

Feffer

[11] 4,142,280

[45] Mar. 6, 1979

[54] BOUNCE CRIMP UNIT WITH ANNULARLY SEGMENTED YARN RECEIVER

[75] Inventor: Philip C. Feffer, Columbia, Md.

[73] Assignee: Chevron Research Company, San Francisco, Calif.

[21] Appl. No.: 825,455

[22] Filed: Aug. 17, 1977

[51] Int. Cl.[2] ..... D02G 1/16; B65H 54/80

[52] U.S. Cl. ..... 28/254; 19/159 R; 28/289; 53/409; 242/83

[58] Field of Search ..... 28/254, 266, 289, 290; 19/157, 159 R, 159 A; 53/3, 116; 242/82, 83

[56] References Cited

U.S. PATENT DOCUMENTS

| | | | |
|---|---|---|---|
| 3,135,038 | 6/1964 | Pflugrad | 19/159 R |
| 3,859,697 | 1/1975 | Guenther | 28/254 |
| 3,991,443 | 11/1976 | Savageau | 19/159 A |

*Primary Examiner*—Louis Rimrodt
*Attorney, Agent, or Firm*—Dix A. Newell; T. G. DeJonghe; Lawrence S. Squires

[57] ABSTRACT

An annularly segmented generally cylindrical pick-up container is disclosed for use in combination with bounce crimping apparatus which texturizes a multi-filament yarn of synthetic resinous material. The container includes a plurality of annular baffles which divide the container into a corresponding plurality of substantially annular chambers. The container is rotated while a texturized multi-filament yarn of synthetic resinous material is deposited into the annular chambers. As one chamber becomes full, the rotational axis of the container is moved to a new position so that the texturized material will begin filling the next radially outwardly adjacent annular chamber.

6 Claims, 5 Drawing Figures

BOUNCE CRIMP UNIT WITH ANNULARLY SEGMENTED YARN RECEIVER

BACKGROUND OF THE INVENTION

This invention relates generally to a bounce crimper for texturizing a multi-filament yarn of synthetic resinous material. More particularly, this invention concerns an annularly segmented cylindrical can adapted to receive texturized yarn from a bounce crimping device.

Bounce crimping apparatus has been effectively used to texturize a multi-filament yarn of synthetic resinous material. See, for example, U.S. Pat. No. 3,887,971 and the other patents cited therein. One particular advantage of such apparatus is the high yarn production rates which are obtained with its use.

In the crimping section of the apparatus, a heated compressible fluid such as steam heats the individual filaments and accelerates the yarn in its longitudinal direction. Typically, the heated compressible fluid is itself accelerated by passing through a restricted orifice so that a high velocity jet is obtained. The jet then drives the yarn and causes acceleration thereof toward a foraminous surface extending across a channel.

The yarn is hurled against the foraminous surface causing individual filaments to be axially compressed and laterally crimped. The yarn, now texturized, rebounds from the screen and passes out of a lateral yarn outlet while most of the compressible fluid goes through the foraminous surface and is discharged from a fluid outlet.

The texturized yarn is cooled prior to being subjected to longitudinal tension to enhance retention of the crimps induced by the bounce crimper assembly. If desired, it also may be subjected to a heat setting treatment in a tensionless state to further enhance crimp performance. Conventionally, the yarn is then collected by a suitable winding mechanism.

One type of device often used to store the yarn in a tensionless state while it is being set to fix the crimp is a J-box into which the highly texturized yarn falls after its passage through the bounce crimping apparatus, prior to collection by the winding mechanism. The use of a J-box, however, requires that the average yarn input and output rates be equal, and this in turn limits the crimping speed to the maximum practical operating speed of the particular winder that is available.

The J-box storage unit also provides a limit on the time of yarn storage in the tensionless state, assuming of course that the input and withdrawal rates are constant. This limit is related to the dimensions of the J-box and is not subject to easy adjustment during operation of the equipment. Hence, changes in heat setting time are not readily achievable independently of the rate at which the yarn moves through the crimping head.

There are other environments where continuous lengths of textile materials need to be stored, and in at least some of these, cans are sometimes used to receive the material. See for example, U.S. Pat. No. 2,924,001. And, in the case of slivers issuing from carding machines, steps have been taken to control the deposit of the slivers so that they will be disposed in the sliver cans in a predetermined arrangement which facilitates endwise withdrawal of the sliver as it is being sent to a subsequent processing step. See for example, the description of such a system at page 235 of *American Cotton Handbook,* 2nd edition, by Gilbert R. Merrill et al, published in 1949 by Textile Book Publishers, Inc. of New York, New York.

However, the techniques employed in these other systems are not directly applicable to the handling of bounced crimped yarns that have loose, crimped, filaments projecting from their surfaces. These filaments are the source of a marked tendency toward entanglement of different yarn portions. Yarn-to-yarn entanglement often requires cutting of the yarn to remove the entanglement followed by splicing of the yarn to attain substantial continuity of its length. Accordingly, the entangled yarn which is excised must be scrapped causing economic waste.

Accordingly, a need continues to exist for an improved system for collecting texturized yarn of synthetic resinous material from a bounce crimping apparatus at high speed without substantial entanglement.

SUMMARY OF THE INVENTION

A system suitable for high speed collection of a texturized yarn of synthetic resinous material from a bounce crimping device, which minimizes entanglement and facilitates handling of the yarn while permitting increased production rates, preferably includes a generally cylindrical container having a plurality of concentric annular walls. The concentric walls define a plurality of generally annular chambers into which the texturized multi-filament yarn is sequentially deposited. Radial spacing between adjacent concentric walls is selected as a function of the denier of the multi-filament yarn being collected with low denier yarns requiring narrower wall spacing than high denier yarns. The container rotates so as to provide controlled toppling of accumulated yarn.

The annularly segmented container is positioned below the yarn outlet of the crimping section such that texturized multi-filament yarn is first deposited in the radially innermost annular chamber. As the container is rotated by suitable rotating means, successive layers of yarn are deposited in the innermost annular chamber to fill that chamber. Then the container is indexed by suitable indexing means to allow the texturized yarn to begin accumulating in the next radially outwardly adjacent annular chamber. The indexing and filling is continued until each annular chamber of the container is filled at which time the container is removed and replaced with an empty container.

During the deposit of layers of yarn in the annular chambers, the rotational speed of the container is controlled so that the small vertical accumulations of yarn that occur as yarn increments fall freely into the container tend to topple in a direction opposite to the direction of container rotation. By exercising careful control over the container speed, the thickness of the yarn layers can be kept at desired values and deleterious tangling of the yarn may be minimized.

In removing the texturized multi-filament yarn from the container, a lid is placed over the container and the yarn is removed in an inverse fashion. More particularly, the end of the yarn which was last deposited in the outer annular chamber is removed first. The multi-filament yarn is then withdrawn through a guide positioned above the axis of the container and the edge of the lid scrapes any loops and tangles from the texturized yarn during withdrawal. Since the container is loaded from the radially innermost to the radially outermost chamber, yarn from the radially innermost chamber will be dragged across two or more walls as well as the lid edge during its removal. Loops and the like removed as the yarn is drawn over the top of an annular wall will not become entangled with yarn in other annular chambers because these chambers will already have been emptied. Thus, the removed yarn will be essentially free of undesirable tangles.

The container will receive the yarn at whatever speed the yarn is delivered to it by the crimper head. There is no limit to the time of storage of the yarn in the container, so that crimp setting treatments of any desired length may be carried out. And, the rate of withdrawal of the yarn from the container may be independent of the rate of deposit. If desired, more than one winder may be employed to handle the output of a single high speed crimping unit.

BRIEF DESCRIPTION OF THE DRAWINGS

Many objects and advantages of the present invention will be apparent to those skilled in the art when this specification is read in conjunction with the attached drawings wherein like reference numerals have been applied to like elements and wherein.

DESCRIPTION OF THE PREFERRED EMBODIMENT

Figure 1:
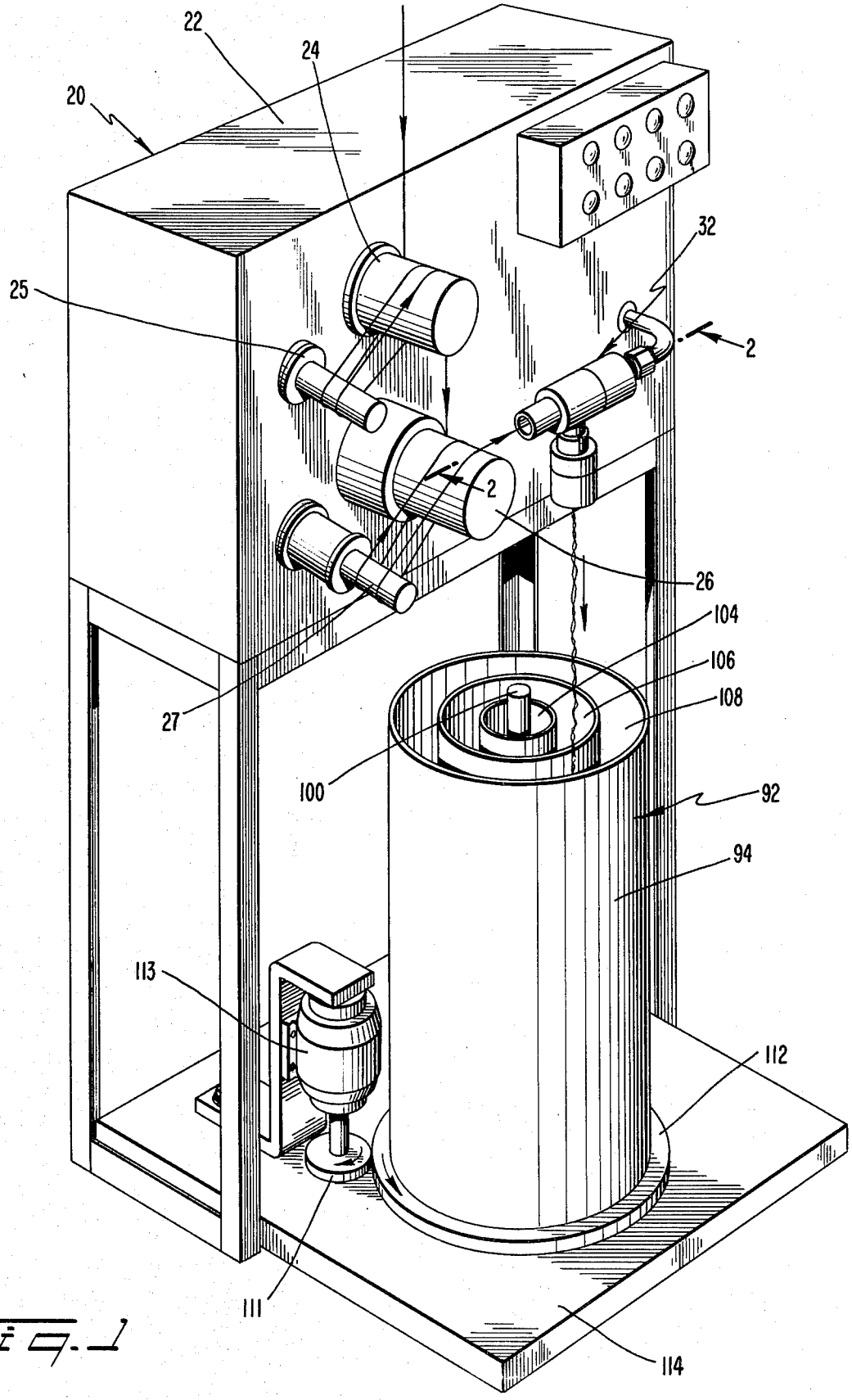
FIG. 1 is a perspective view of a bounce crimping device having a container constructed in accordance with the present invention.

A texturizing apparatus 20 (see FIG. 1) includes a frame 22 having a first pair of rolls 24, 25 around which the incoming undrawn multi-filament yarn is wrapped a plurality of times. The multi-filament yarn includes many essentially continuous filaments of a synthetic resinous material, such as polypropylene. From the first set of rolls 24, 25 the multi-filament yarn advances to a second set of rolls 26, 27 which rotate at a higher surface speed than that of the first set of rolls 24, 25. With the second set of rolls rotating at the higher surface speed, the yarn is drawn between the two sets of rolls to longitudinally elongate the individual yarn filaments. The drawn multi-filament yarn may then enter a bounce crimping section or device 32.

Figure 2:
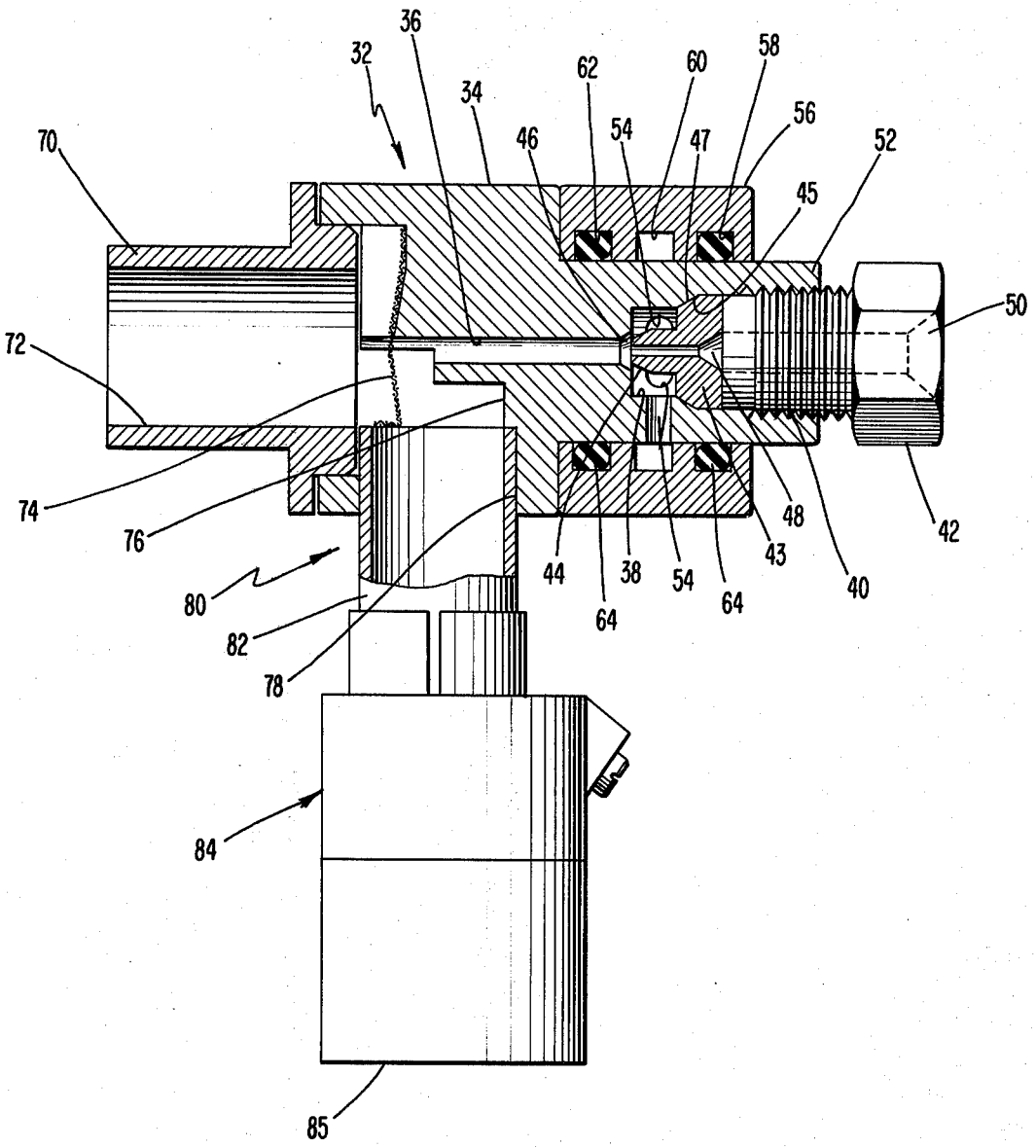
FIG. 2 is a cross-sectional view depicting details of a bounce crimper.

The bounce crimping device 32 (see FIG. 2) includes a body or housing portion 34 having a longitudinal channel or bore 36 extending therethrough. The upper end of the bore 36 has an enlarged end portion 38 having an internally threaded section 40 that receives an externally threaded backing plug 42.

The backing plug 42 retains an orifice plug 43 in the bore portion 38 such that mating frustoconical surfaces 45, 47 longitudinally position the orifice plug 43. The orifice plug 43 includes a frustoconical surface portion 44 on its distal end. The frustoconical surface 44 cooperates with a second frustoconical surface 46 positioned between the bore 36 and the enlarged end portion 38 thereof to define an annular orifice. The orifice provides fluid communication between the enlarged end portion 38 and the longitudinal bore 36.

The backing plug 42 and the orifice plug 43 each include a longitudinal channel 48 which extends therethrough from the top surface 50 of the backing plug 42 to the distal end of the orifice plug 43 downstream of the annular orifice to define a yarn inlet orifice. The channel 48 provides a passageway to the bore 36 for untexturized yarn of the synthetic resinous material which is to be texturized.

The body 34 has a generally cylindrical end portion 52 within which the backing plug 42 is threadably received. The cylindrical portion 52 has a generally circular cross section, extends from a location below the orifice, and is provided with a plurality of radially extending ports 54. The ports 54 communicate with the enlarged end portion 38 of the longitudinal bore upstream of the frustoconical surface 46.

An annular manifold block 56 is mounted circumferentially around the cylindrical portion 52 and includes three annular recesses 58, 60, 62 in the inner surface. Each recess 58, 60, 62 faced the cylindrical end portion 52 and extends radially outwardly therefrom. The upper and lower recesses 58, 62 are adjacent to corresponding ends of the manifold block 56 and each is adapted to receive a suitable conventional O-ring seal 64. Each seal 64 is effective to provide a pressure seal between the ends of the manifold block 56 and the cylindrical end portion 52 so that the recess 60 is isolated.

The central recess 60 communicates with a conduit (not shown) which may be connected to a suitable conventional source of heated pressurized gas (not shown) such as steam.

At the lower end of the body portion 34 is an exhaust housing 70 which defines a fluid outlet. The exhaust housing includes a longitudinal extending bore 72 in general coaxial alignment with the bore 36 of the body portion 34. Positioned between the body portion 34 and the exhaust portion 70 and transversely of the channel is a suitable conventional foraminous surface 74, such as a screen. A lateral yarn discharge opening 76 communicates with the bore 36 at the position of the foraminous sheet 74 and is aligned substantially perpendicularly with respect to the bore 36. The discharge opening 76 communicates with one end 78 of a tubular conduit means 80.

A second end 82 of the tubular conduit means 80 has a restrictor assembly 84 which controls the discharge of texturized multi-filament yarn from the conduit means 80. The restrictor assembly 84 may, for example, include a resilient member which protrudes into the internal passage of the conduit means 80 so as to impede the progress of the yarn and thereby assure a reasonable level of compaction thereof. The yarn then passes out of a second end 85 of the restrictor assembly 84.

Figure 3:
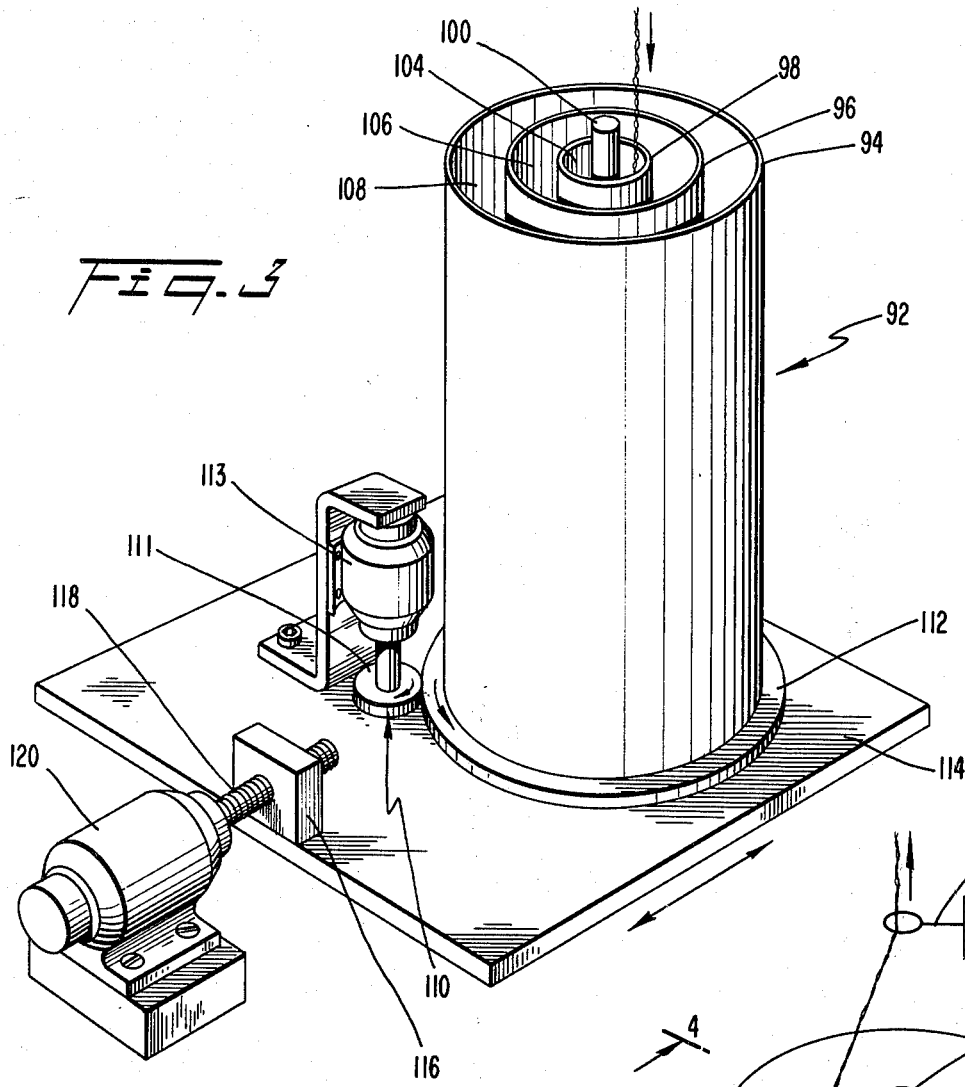
FIG. 3 is a perspective view of the container along with its rotating and advancing mechanisms.

Texturized yarn from the bounce crimper device 32 is discharged from restrictor assembly 84 and allowed to drop vertically downwardly into a novel rotating container or can 92 (see FIG. 3). The container 92 includes a plurality of concentric annular walls 94, 96, 98 and a coaxially disposed rod 100.

Figure 4:
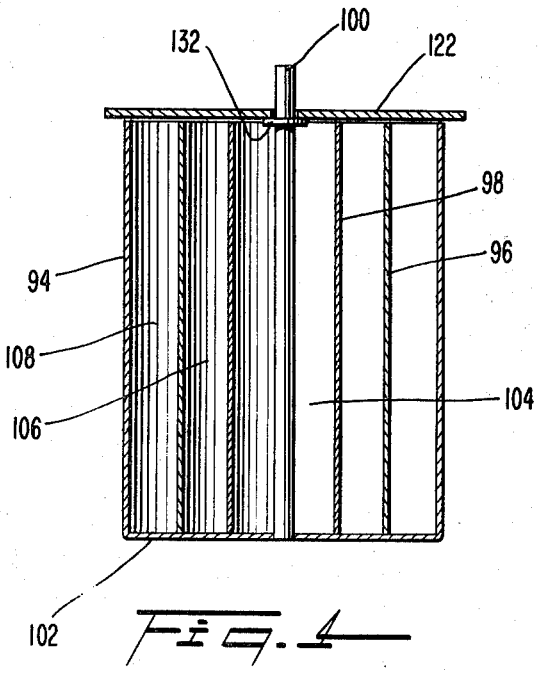
FIG. 4 is a view in partial cross section taken along the line 4—4 of FIG. 5.

As seen in FIG. 4, the annular walls 94, 96, 98 extend vertically upwardly from a substantially planar base 102 to which the central rod 100 is also connected. The walls 94, 96, 98 and essentially coextensive and the rod 100 extends beyond the upper edges of the walls. The rod 100 and the radially innermost wall 98 cooperate to define a first annular chamber 104. Similarly, the inner wall 98 and the middle wall 96 define a second annular chamber 106, and the middle wall 96 and the outer wall 94 define a third annular chamber 108. Each annular chamber 104, 106, 108 is adapted to receive the texturized yarn from the bounce crimper assembly 32.

While the container 92 is described with three annular walls, it will be apparent to those skilled in the art that any desired number of walls, with annular chambers therebetween, may be utilized.

In the texturizing apparatus, the container 92 is positioned coaxially on a rotary table 112 (see FIG. 3) that is mounted on a carriage 114. A suitable conventional rotary drive 110 engages the table 112 and rotates it at a uniform angular velocity.

The rotary drive 110 is also mounted on the carriage 114 and may, for example, consist of a small disc 111 driven by a suitable conventional motor 113 carried by the carriage 114. The disc 111 may frictionally engage the periphery of the rotary table 112 so as to impart rotation thereto.

The spacing between adjacent ones of the annular walls 94, 96, 98 and the speed of rotation of the scan 92 are selected so that a generally uniform layer of yarn is formed in one of the annular chambers 104, 106, 108 during each revolution of the can. As the yarn falls into a chamber, there will be a small, generally vertical, buildup or pile formation that has a tendency to topple over. It is desirable that the spacing between the side walls of the chamber be narrow enough to inhibit lateral, as opposed to circumferential, toppling. Moreover, with respect to the circumferential toppling, it is preferred that the rotation rate of the can be selected so as to promote forward toppling in the direction in which the yarn layer is being laid down in the chamber, that is in a direction opposite that of the container rotation.

Such controlled deposit of the crimped yarn minimizes layer-to-layer entanglement effects, and the yarn is particularly well positioned for subsequent removal in an orderly fashion and free from tangles. Although the spacings and speeds required are not highly critical for many operations, these factors should be kept in mind particularly when changes are being made in the yarn to be processed. Low denier yarn has been observed to make slenderer piles than high denier yarn, so that reductions in spacing and/or changes in speed may be required to preserve the desired toppling pattern after a shift to a low denier yarn.

In order to move the container 92 relative to the discharge of the bounce crimper assembly, an indexing mechanism may be provided. The indexing mechanism may include a bracket 116 (FIG. 3) attached to the frame and operable to receive a rotatable threaded shaft 118. The shaft 118 may be intermittently driven by a suitable conventional motor 120 attached to the frame or another stationary object.

In operation, the bounce crimped multi-filament yarn drops essentially vertically downwardly into the first annular chamber of the container 92. While the yarn drops into the first annular chamber 104, the container 92 is rotated by the rotary drive 110 (see FIG. 3) so that the texturized material can be laid in all circumferential portions of the chamber 104.

When the first annular chamber has been filled with texturized yarn, the carriage 114 is advanced by the indexing assembly to displace the axis of the rod 100 radially so that the texturized yarn begins to fill the second annular chamber 106. The indexing distance is essentially the radial distance between the middle of adjacent annular chambers. The container 92 continues to rotate so that the yarn accumulates in an essentially helical layer having a predetermined thickness from the bottom to the top of the chamber 106. When the second annular chamber 106 has been filled with texturized yarn, the indexing assembly is again actuated to reposition the container 92 relative to the texturizing apparatus so that the texturized yarn will then be deposited in the third annular chamber 108. Again, the container continuously rotates until the annular chamber is filled with texturized yarn.

It will be noted that the rate of rotation may be adjusted simultaneously with radial indexing in order to provide an appropriate tangential velocity.

When all annular chambers of the container 92 have been filled, the full container 92 is removed and the carriage 114 is repositioned by the index assembly to its initial location. A new container 92 is placed in material receiving position. The texturized multi-filament yarn may be severed so that there is no connection between successive containers. The yarn in the full container 92 may then be treated by heat setting or stored in the container or taken directly to another processing station.

Figure 5:
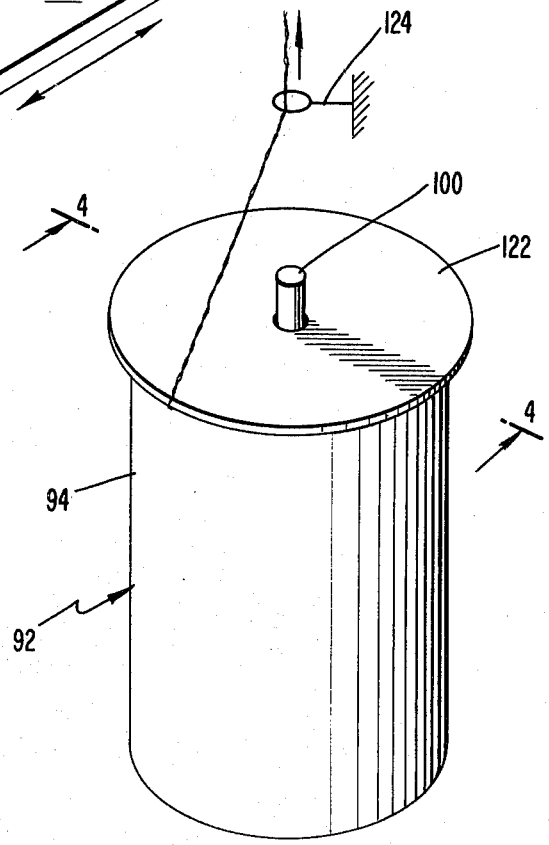
FIG. 5 is a perspective view illustrating withdrawl of fibrous material from the container.

At a new processing station, the texturized multi-filament yarn must be removed from the container 92. In this connection (see FIG. 5), a lid 122 is positioned over the projecting end portion of the rod 100. The rod 100 projects through the lid 122, is effective to radially position the lid with respect to the container 92 and has a protuberance 132 (FIG. 4) to hold the lid above the walls so that a space is provided for yarn passage.

Now, with the container 92 stationary, the severed end of the texturized material is passed through a suitable conventional guide 124 which may be located above the container. The guide 124 is preferably spaced above the container by a vertical distance at least as great as the diameter of the container 92 and preferably as high as possible. The need to reach the guide 124 for string-up purposes provides an effective upper limit. By placing the guide as high as is practical, the yarn can more readily rotate about the edge of the lid 122 to approximate the circumferential location from which yarn is being withdrawn and facilitate yarn removal.

As tension is applied to the multi-filament yarn being withdrawn from the container 92, the material is withdrawn and scraped over the peripheral edge of the lid 122 (see FIG. 4). In addition, the small clearance between the upper edge of the wall and the underside of the lid aids removal of yarn tangles. When the radially outermost chamber has been emptied, the next radially inward chamber 106 begins to empty, with the yarn being pulled between the upper edges of the two walls 94, 96 and the underside of the lid 122. The withdrawal process from the second annular chamber 106 continues until it too is empty, at which time the first annular chamber 104 begins to empty. With the first annular chamber 104, the fibers are drawn across the upper edge of three consecutive walls, each of which provides a scraping to remove tangles from the material.

Since the tangential velocity of the innermost chamber is less than the tangential velocity of outer chambers, it is expected that entanglement from toppling is more likely to occur there than at radially outer portions of the container. Accordingly, the entanglement of the radially innermost chambers is greater than the entanglement existing in the radially outermost chamber. Therefore, the additional scraping provided by additional walls provides a staged tangle-removing assembly which improves tangle removal.

It should now be apparent that there has been provided in accordance with the present invention a process and container for use in combination with bounce crimping apparatus which facilitate accumulation of texturized multi-filament yarn without entanglement and which permits the removal of the multi-filament yarn from the container with a minimal amount of entanglement in the resultant yarn. Moreover, it will be apparent to those skilled in the art that numerous modifications, variations, substitutions and equivalents may be made for features of the invention without departing from the spirit and scope thereof. Accordingly, it is expressly intended that all such modifications, variations, substitutions and equivalents which fall within the spirit and scope of the invention as defined in the appended claims be embraced thereby.

What is claimed is:

1. In an apparatus for bounce crimping a multi-filament yarn of synthetic resinous material having a crimper housing having a yarn inlet for receiving the multi-filament yarn to be texturized, a fluid outlet aligned with the inlet, a channel extending between the yarn inlet and the fluid outlet, and a lateral yarn outlet communicating with the channel, means for supplying a heated fluid to the channel for drawing the yarn into the housing, a foraminous surface positioned across the channel between the lateral yarn outlet and the fluid outlet, the heated fluid further serving to hurl the yarn against the foraminous surface to axially compress and crimp the yarn filaments and bounce the multi-filament yarn through the lateral yarn outlet, and means for collecting the crimped yarn while maintaining the yarn substantially free of longitudinal tension, the improvement being an improved collection means for receiving and storing the texturized yarn without excessive entanglement comprising:

container means having an axis and a plurality of substantially annular baffles which define a plurality of concentric annular chambers and being operable to receive the texturized yarn from the lateral yarn outlet, the annular baffles being radially spaced from one another by a preselected distance which inhibits toppling of yarn accumulations radially with respect to the container means;

rotary drive means operatively positioned to rotate the container means about the axis while the container means receives the texturized yarn; and indexing means for aligning each annular chamber and the lateral yarn outlet as an adjacent chamber becomes full of texturized yarn.

2. The apparatus of claim 1 wherein rotary drive means is operable at a rate which promotes toppling of yarn accumulations circumferentially in a direction opposite to the direction of container rotation.

3. In a process of bounce crimping a multi-filament yarn having the steps of:

feeding the multi-filament yarn of synthetic resinous material to the inlet of a bounce crimping housing having a foraminous screen therein, accelerating the yarn within the crimper housing by means of heated compressible fluid, hurling the yarn longitudinally so as to bounce the yarn from the foraminous screen to axially compress and laterally crimp filaments of the yarn, discharging substantially all of the heated compressible fluid from a fluid outlet of the housing downstream of the foraminous screen, and delivering the crimped yarn laterally from said compressible fluid as it bounces from said foraminous surface, the improvement comprising the steps of:

providing a container having a plurality of annular baffles radially spaced from one another by a preselected distance selected to inhibit radial toppling of the texturized multi-filament yarn;

depositing the texturized multi-filament yarn of synthetic resinous material in an annular chamber of the collection device;

rotating the collection device about an axis such that the texturized yarn accumulates in the annular chamber;

moving the container relative to the crimper housing when the annular chamber is full so that the texturized yarn is deposited in a second annular chamber concentric with the first annular chamber; and continuing rotation of the container until the second annular chamber is full.

4. The process of claim 3, including the further steps of:

moving the container relative to the bounce crimper housing when the second annular chamber is full so that texturized yarn is deposited in a third chamber concentric with the first annular chamber; and continuing rotation of the container until the third annular chamber is full.

5. The process of claim 3, wherein the moving step includes displacing the axis of the container away from the bounce crimper housing so that the second annular chamber to be filled will be radially external of the first annular chamber.

6. The process of claim 3, wherein said rotation is carried out at a predetermined rotation rate such that the accumulating texturized yarn topples forwardly to provide controlled toppling thereof.

* * * * *